US006152804A

United States Patent [19]

Okuyama

[11] Patent Number: 6,152,804

[45] Date of Patent: Nov. 28, 2000

[54] GRINDING METHOD AND GRINDING APPARATUS

[75] Inventor: Shinichi Okuyama, Nagaoka, Japan

[73] Assignee: System Seiko Co., Ltd., Niigata, Japan

[21] Appl. No.: 09/343,833

[22] Filed: Jun. 30, 1999

[30] Foreign Application Priority Data

Jul. 15, 1998 [JP] Japan ..... 10-200710

[51] Int. Cl.[7] ..... B24B 49/00

[52] U.S. Cl. ..... 451/19; 451/24; 451/28; 451/268; 451/287; 451/291

[58] Field of Search ..... 451/19, 24, 26, 451/41, 262, 268, 287, 291

[56] References Cited

U.S. PATENT DOCUMENTS

| | | | |
|---|---|---|---|
| 3,019,563 | 2/1962 | Martin | 451/19 |
| 4,742,651 | 5/1988 | Wittstock | 451/24 |
| 4,837,982 | 6/1989 | Berkeley et al. | 451/24 |
| 5,086,591 | 2/1992 | Panetti | 451/24 |
| 5,325,636 | 7/1994 | Attanasio et al. | 451/24 |
| 5,355,634 | 10/1994 | Araki et al. | 451/24 |
| 6,001,005 | 12/1999 | Anderson, III et al. | 451/19 |

FOREIGN PATENT DOCUMENTS

| | | | |
|---|---|---|---|
| 63-22266 | 1/1988 | Japan | B24B 37/00 |
| 2556605 | 9/1996 | Japan | B24B 37/04 |

*Primary Examiner*—M. Rachuba

*Attorney, Agent, or Firm*—McCormick, Paulding & Huber LLP

[57] ABSTRACT

A work W is rotated on a lower grinding wheel 13 provided on a work support base 11. Both surfaces of the work W are simultaneously subjected to grinding process by an upper grinding wheel 24 provided on a grinding shaft 22 of a grinding head 21 and the lower grinding wheel 13. The work W is applied with a pressure force of a primary load through the grinding shaft 22 by a piston rod 36 of a primary pneumatic cylinder 35 which is operated by a first air pressure. The work W is also applied with a pressure force of a secondary load through a lever member 43 by a piston rod 46 of the secondary pneumatic cylinder 45 which is operated by a second air pressure higher than the first air pressure. By adjusting the second air pressure, the pressure force is controlled.

3 Claims, 4 Drawing Sheets

GRINDING METHOD AND GRINDING APPARATUS

BACKGROUND OF THE INVENTION

The present invention relates to a grinding technique in which a pressure force is applied to the surface of a work so as to grind the work by a grinding tool.

In case of flatly grinding the surface of a work to be processed while rotating a grinding wheel, the outer circumferential surface of the grinding wheel is brought into contact with the work or an end surface of the grinding wheel is brought into contact with the work. Therefore, the work to be processed is set on a fixed table or a rotation table.

In case where both surfaces of an aluminum substrate for a magnetic disk, as a work, are simultaneously ground, for example, an apparatus disclosed in the Publication of Japanese Patent No. 2556605 is used. This apparatus has a lower platen having an upper surface where a ring-like lower grinding wheel is provided, and an upper platen having a lower surface where a ring-like upper grinding wheel is provided so as to face the lower grinding wheel. The work is set in a holding hole formed in a plurality of carriers provided on the lower grinding wheel. Each carrier is engaged with a sun gear provided rotatably at the rotation center portion of the lower platen and is also engaged with an inner-toothed gear provided outside the lower platen. In this manner, both surfaces of the work held by the carriers are ground by the upper and lower grinding wheels, by rotating the upper and lower level disks in a state in which the sun gear is rotated and the work is revolved while rotating about the sun gear.

In the grinding process of a work with use of a grinding wheel, it is necessary that the pressure force applied to the work from a grinding wheel is set to a predetermined value. Therefore, developments have been made for a technique in which the pressure force applied to the grinding wheel is detected by a sensor and an air pressure supplied to a pneumatic cylinder which applies the pressure force to the grinding wheel is controlled based on a detection value by a sensor and a reference value depending on the air pressure (for example, see Japanese Patent Laid-Open Publication No. 63-22266).

However, in case where the pressure force is set by controlling the air pressure supplied to the pneumatic cylinder for moving the grinding wheel close to and apart from the work, it is difficult to control the load with high precision such that the pressure force becomes equal to the target load. In case of processing a work with use of a grinding wheel, it has been found that the pressure force applied to the work from the grinding wheel greatly influences the processing precision of the work, so it is significant to control the pressure force to an optimum condition.

SUMMARY OF THE INVENTION

An object of the present invention is to enable highly precise control of the pressure force to the work from a grinding tool in a grinding apparatus.

The grinding method according to the present invention comprises steps of: rotating and driving a grinding tool in contact with a work, by a grinding shaft; supplying a first fluid pressure to a primary fluid pressure cylinder having a first piston rod connected with the grinding shaft, thereby to apply a primary load to the grinding shaft; supplying a second fluid pressure higher than the first fluid pressure, to a secondary fluid pressure cylinder having a second piston rod connected between both end portions of a lever member connected to the first piston rod, the lever member having a swing center portion at one of the end portions, and the other one of the end portions being connected with the first piston rod; controlling the second fluid pressure to adjust the secondary load; and grinding the work by the grinding tool under condition that the primary load and the secondary load adjusted are applied to the grinding shaft.

The grinding apparatus according to the present invention comprises: a support base for supporting a work; a grinding head provided with a grinding shaft for rotating and driving a grinding tool for grinding the work, the grinding head being provided to be opposed to the support base; a primary fluid pressure cylinder operated by the first fluid pressure, the primary fluid pressure cylinder having a first piston rod connected to the grinding shaft; a lever member having end portions, one of which portions is set on the grinding head such that the lever member can swing, and the other of which portions is connected with the first piston rod; a secondary fluid pressure cylinder operated by a second fluid pressure higher than the first fluid pressure, the secondary fluid pressure cylinder having a second piston rod connected between both end portions of the lever member; and a fluid pressure regulation means for controlling the second fluid pressure applied to the secondary fluid pressure cylinder, wherein a primary load depending on the primary fluid pressure cylinder is applied to the grinding shaft and a secondary load depending on the secondary fluid pressure cylinder is applied to the grinding shaft through the lever member. A pressure receiving area of the secondary fluid pressure cylinder may be set to be smaller than a pressure receiving area of the primary fluid pressure cylinder.

According to the present invention, a fluid pressure higher than the fluid pressure applied to the primary fluid pressure cylinder is applied to the secondary fluid pressure cylinder, and the pressure force applied to the grinding shaft is adjusted by controlling the fluid pressure applied to the secondary fluid pressure cylinder. Therefore, the pressure force can be controlled with high precision. If the pressure receiving area of the secondary fluid pressure cylinder is set to be smaller than the pressure receiving area of the primary fluid pressure cylinder, the second fluid pressure can be set to a value higher than the first fluid pressure.

DESCRIPTION OF THE PREFERRED EMBODIMENT

In the following, the embodiments of the present invention will be specifically explained on the basis of the drawings.

Figure 1:
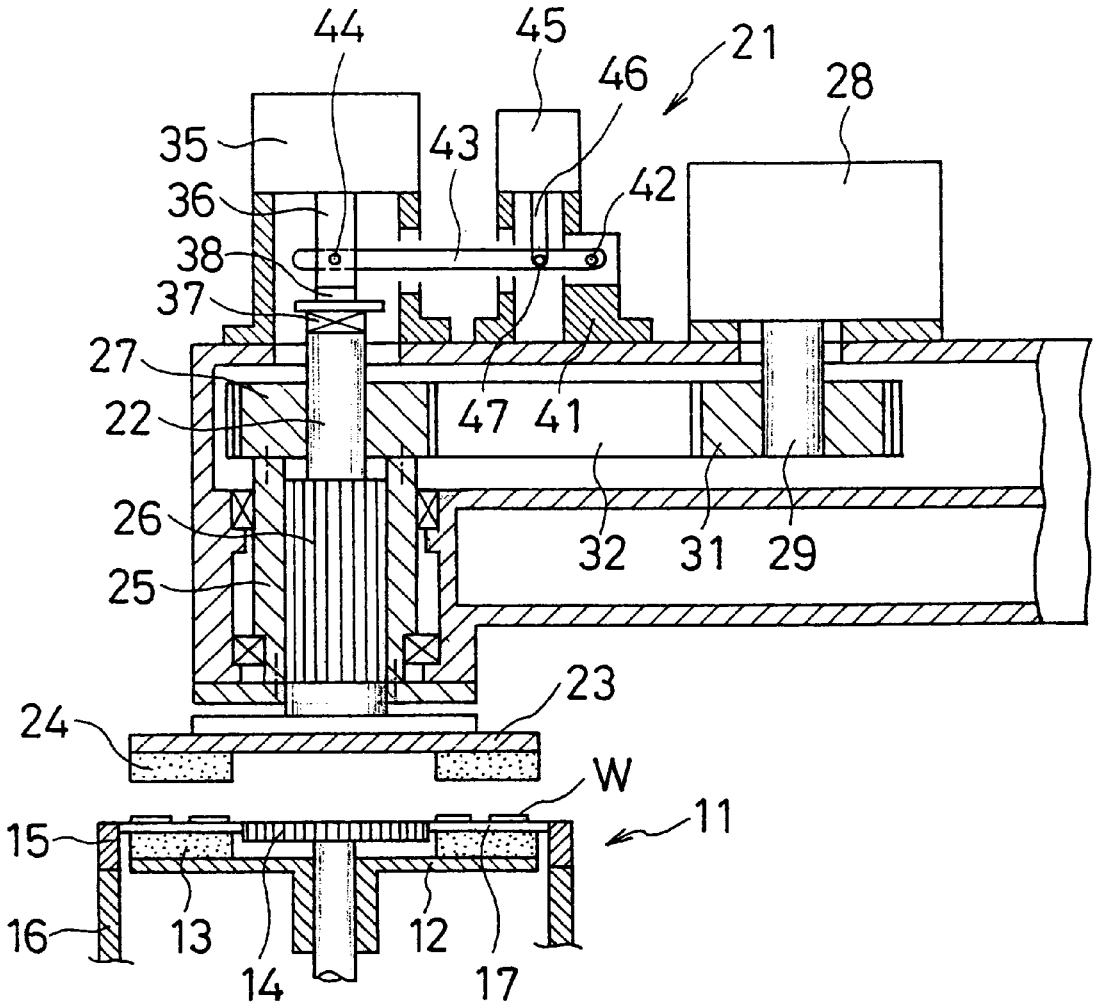
FIG. 1 is a cross-sectional view showing a grinding apparatus as an embodiment of the present invention.

FIG. 1 is a cross-sectional view showing a grinding apparatus as an embodiment of the present invention. This grinding apparatus comprises a work support base 11 for supporting a work W, and a grinding head 21 provided above and opposed to the work support base 11.

Figure 2:
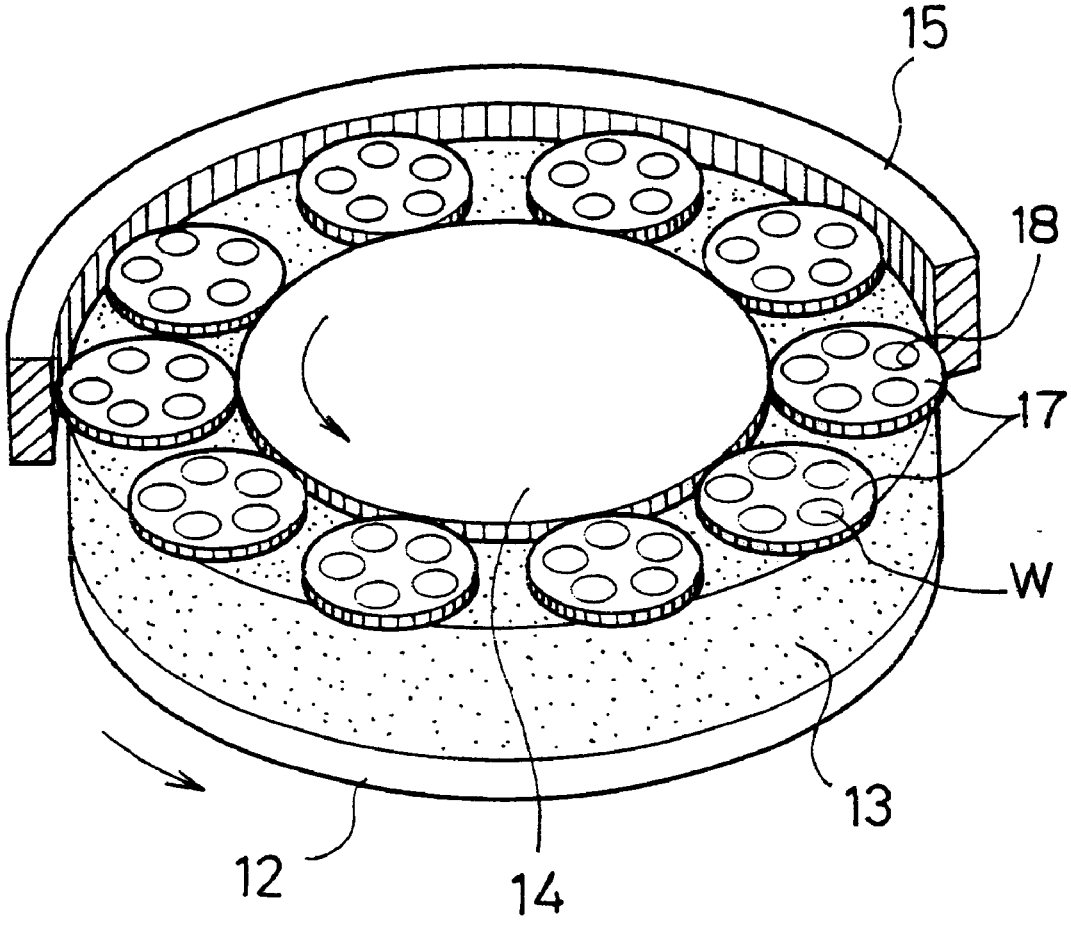
FIG. 2 is a perspective view showing a work support base shown in FIG. 1.

The work W is an aluminum substrate for a magnetic disk as described above, and the support base 11 is arranged as shown in FIG. 2. The work support base 11 has a lower platen 12 of a rotation table type which is rotatable in the direction indicated by an arrow in FIG. 2, and a ring-like lower grinding wheel 13 is set on the upper surface of the lower platen 12. A sun gear 14 having an outer diameter smaller than the inner diameter of the lower grinding wheel is provided at the rotation center portion of the lower platen, to be rotatable in the same direction as the lower platen 12, as indicated by an arrow. A ring-like inner-toothed gear 15 having a diameter larger than the outer diameter of the lower grinding wheel 13 is fixed to a base seat 16, so as to surround the lower platen 12.

In the case of the figure, ten carriers 17 are provided between the sun gear 14 and the inner-toothed gear 15, and circular five holding holes 18 for containing works W are formed in each of the carriers 17, and the thickness of the carrier 17 is formed to be smaller than that of the work W.

When the sun gear 14 is rotated in such a state that each carrier 17 is engaged between the sun gear 14 and the inner-toothed gear 15, each carrier 17 revolves around the sun gear 14 with rotating about its own axis since the inner-toothed gear 15 is fixed. Therefore, the works W moves in the horizontal direction, drawing a cycloidal curve or a trochoid curve, in contact with the lower grinding wheel 13 in the horizontal plane by the carriers 17.

The grinding head 21 is movable in the vertical direction and the horizontal direction by a drive means, which is not shown. The upper platen 23 is set on the lower end portion of a grinding shaft 22 provided rotatably on the grinding head 21, and an upper grinding wheel 24 having a ring-like shape corresponding to the lower grinding wheel 13 is fixed to the upper platen 23.

The grinding shaft 22 is engaged with a drive sleeve 25 provided rotatably on the grinding head 21, at the portion of the direct acting guide portion 26 provided for the grinding shaft 22, such that the grinding shaft 22 is vertically movable. The grinding shaft 22 is movable in the axial direction with a predetermined stroke in relation to the drive sleeve 25 and is also rotatable integrally with the drive sleeve 25. To drive and rotate the grinding shaft 22, a timing belt 32 is tensioned between a pulley 27 fixed to the drive sleeve 25 and a pulley 31 fixed to a shaft 29 of a grinding shaft rotation motor 28.

To move the grinding shaft 22 vertically with a predetermined stroke and to apply a primary load to the grinding shaft 22, a primary pneumatic cylinder 35 is attached to the grinding head 21. A first piston rod 36 which is moved forward and backward by the pneumatic cylinder 35 is connected with the grinding shaft 22 through a thrust bearing 37. To detect the pressure force applied to the grinding shaft 22, the first piston rod 36 is provided with a load sensor 38.

A lever member 43 is attached to a bracket 41 fixed to the grinding head 21 by a pin 42 such that the lever member 43 can swing freely in the vertical direction at an end portion of the lever member 43, and the other end portion of the lever member 43 is connected with a first piston rod 36 through a pin 44 fixed to the first piston rod 36. A secondary pneumatic cylinder 45 is attached to the grinding head 21, and the second piston rod 46 which moves forward and backward by the pneumatic cylinder 45 is connected with the lever member 43, at the portion between both end portions of the lever member 43.

Figure 3:
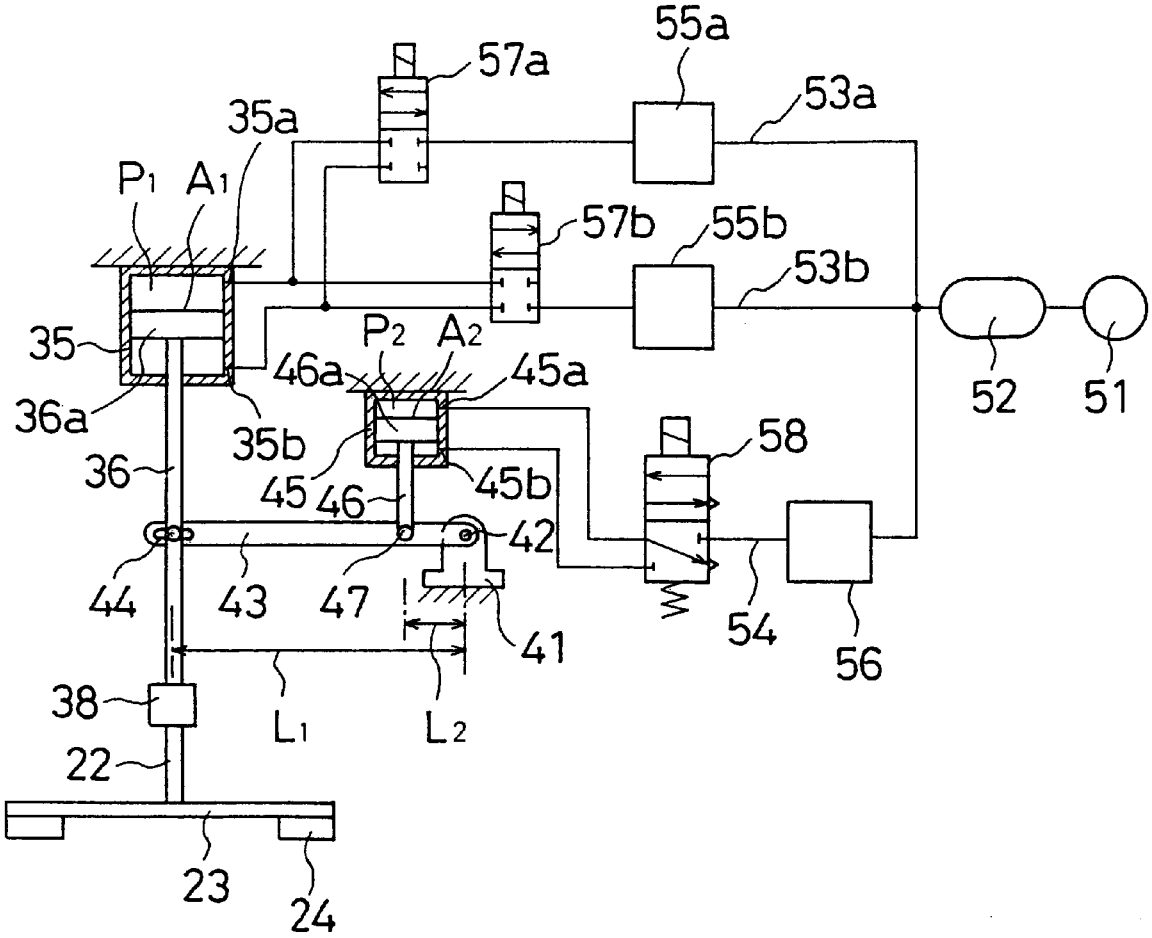
FIG. 3 is a schematic view showing the connection between a lever member and two pneumatic cylinders.

FIG. 3 is a schematic view showing the connection between the lever member 43 and two pneumatic cylinders 35 and 45. Supposing that the position of the pin 42 is a fulcrum and the position of the pin 44 is an action point, the dimension between these positions is $L_1$. Supposing that the position of the pin 47 is a load point, the dimension between the fulcrum and the load point is $L_2$. In the case of the figure, the ratio of $L_1$ to $L_2$ is approximately set to 5:1. Where the pressure receiving area of the piston 36*a* of the primary pneumatic cylinder 35 is $A_1$ and the pressure receiving area of the piston 46*a* of the secondary pneumatic cylinder 45 is $A_2$, the ratio of $A_1$:$A_2$ is approximately set to 5:1. Where the air pressure supplied from a supply port 35*a* into the primary pneumatic cylinder 35 is $P_1$ and the air pressure supplied from the supply port 45*a* into the secondary pneumatic cylinder port 45*a* is $P_2$ when the first piston rod 36 is pushed down to apply a pressure force to the upper grinding wheel 24, the ratio of $P_1$:$P_2$ is approximately set to 1:25.

In this manner, the difference between the pressure force of the primary load applied to the grinding shaft 22 by the primary pneumatic cylinder 35 and the pressure force of the secondary load applied to the grinding shaft 22 from the action point by the secondary pneumatic cylinder 45 becomes small. Therefore, the ratios of the air pressures, the pressure receiving areas, and the lengths to the load points can be set to arbitrary ratios, as far as the secondary load can be controlled within a range within which the target pressure force can be set by adding the pressure force applied to the grinding shaft, to the primary load, with this primary load used as a reference.

In the case of the figure, according to the ratio of the lengths of the lever member 43, a load which is five times larger than the secondary load applied to the grinding shaft 22 from the position of the action point of the pin 44 can be applied to the secondary pneumatic cylinder 45 at the load point of the pin 47, so the pressure force can be controlled by controlling the high air pressure applied to the cylinder 45.

By supplying an air with a constant first pressure $P_1$, which is set previously, from the supply/exhaust port 35*a* of the primary pneumatic cylinder 35, the pressure force of the primary load applied to the grinding shaft 22 by the first piston rod 36 is set to be constant. In contrast, the second pressure $P_2$ supplied from the supply/exhaust port 45*a* of the secondary pneumatic cylinder 45 can be controlled. By controlling this second pressure, an adjusted pressure force of the secondary load is applied to the grinding shaft 22.

For example, suppose that the first pressure $P_1$ is 0.126 kg/cm$^2$, the second pressure $P_2$ is 3.304 kg/cm$^2$, and the target pressure force applied to the upper grinding wheel 24 through the grinding shaft 22 is about 10 kgf. To control the tolerable range of the target pressure force to be 5% or less, the pressure tolerable value of the pressure $P_1$ must be within ±0.0021 kg/cm$^2$ if the pressure force is controlled only by the pressure $P_1$. In contrast, in case where the first pressure $P_1$ is kept constant and the pressure $P_2$ higher than the pressure $P_1$ is controlled, the tolerable range of the target pressure force can sufficiently be set to be 5% or less if the pressure $P_2$ is controlled with the range of ±0.0551 kg/cm$^2$, as in the present invention.

Thus, according to the present invention, the pressure force of the primary load is applied directly to the grinding shaft 22 by the primary pneumatic cylinder 35, and the pressure force generated by the secondary pneumatic cylinder 45 applied with the second air pressure $P_2$ higher than the first air pressure $P_1$ applied to the primary pneumatic cylinder 35 is converted through the lever member 43 into a small secondary load, which is indirectly applied to the grinding shaft 22. As a result of this, the secondary load can be controlled by controlling the second pressure applied to the secondary pneumatic cylinder 35 which generates a large load, so the pressure force applied to the works W through the grinding shaft 22 can be adjusted with high precision. If the target load is adjusted by controlling the second pressure which is higher than the first pressure, the control can be achieved over a large pressure range, so that fine control of the secondary load can be performed relatively, i.e., control can be performed with high precision. Accordingly, the pressure force applied to the grinding shaft 22 can be controlled with high precision.

In particular, if the pressure receiving area of the secondary pneumatic cylinder 45 is set to be smaller than the pressure receiving area of the primary pneumatic cylinder 35, as described above, the second pressure can be set to be much larger than the first pressure, so the error of the control target load can be reduced to be small.

To supply compressed air to each of the pneumatic cylinders 35 and 45, the tank 52 connected to the air pressure pump 51 is connected with air pressure pipes 53*a,* 53*b* and 54. The air pressure pipe 53*a* is connected to the supply-exhaust port 35*a* of the primary pneumatic cylinder 35, and the air pressure pipe 53*a* is provided with a regulating valve 55*a* for setting the first pressure for applying the primary load to the grinding shaft 22. The air pressure pipe 53*b* is connected to the supply-exhaust port 35*b* of the primary pneumatic cylinder 35, and the air pressure pipe 53*b* is provided with a regulating valve 55*b* for setting a higher pressure than the first pressure to move upward the grinding shaft 22 together with the upper platen 23 and the upper grinding wheel 24.

Meanwhile, the air pressure pipe 54 is provided with a pressure regulator 56 for adjusting the pressure of the compressed air to be supplied to the secondary pneumatic cylinder 45. An electropneumatic regulator or the like is used as the pressure regulator 56, and the air pressure applied to the secondary pneumatic cylinder 45 is controlled by an electric signal supplied from a control circuit.

To switch the supply and exhaustion of air with respect to the cylinder through the supply-exhaust ports 35*a* and 35*b* of the primary pneumatic cylinder 35, a switch valve 57*a* is provided for the air pressure pipe 53*a,* and a switch valve 57*b* is provided for the air pressure pipe 53*b*. Further, to perform supply/exhaustion of the air with respect to the cylinder through the supply-exhaust ports 45*a* and 45*b* of the secondary pneumatic cylinder 45, a switch valve 58 is provided for the air pressure pipe 54. Electromagnetic valves are used as the 57*a,* 57*b* and 58, and switching operation is performed by an electric signal. Note that the first air pressure $P_1$ may be changed by using an electropneumatic regulator in place of the regulating valve 55*a*.

Figure 4:
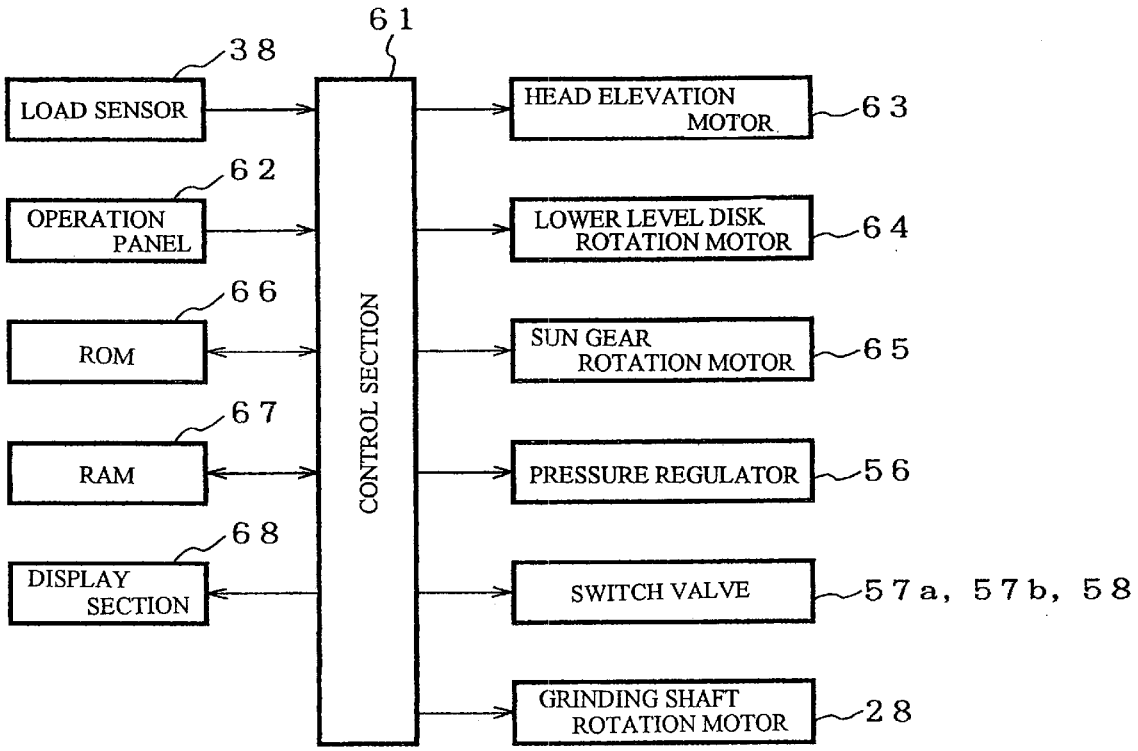
FIG. 4 is a block diagram showing a control circuit of the grinding apparatus.

FIG. 4 is a block diagram showing a control circuit for controlling the operation of the grinding apparatus, and the control section 61 including a CPU (central processing unit) or the like is inputted with signals through an input key for instructing start of the apparatus, a key for inputting the pressure force, and a load sensor 38. The control section 61 supplies operation signals to a head elevation motor 63 for moving up and down the grinding head 21, to a sun gear rotation motor 65 for driving and rotating the sun gear 14, and to a grinding shaft rotation motor 28 for driving and rotating the grinding shaft 22. Further, the control section 61 also supplies operation signals to the pressure regulator 56 and the switch valves 57*a,* 57*b* and 58.

The control section 61 is provided with an amplifier for amplifying analog signals from the load sensor 38 and the like, an A/D converter for converting the analog signals into digital signals, a D/A converter for converting digital signals outputted to the pressure regulator 56, into analog signals, and the like. Also, the control section 61 is connected with ROMs 66 and 67 which store calculation formulas and map data concerning correspondences to the voltage values to be outputted to the pressure regulator 56 in accordance with signals from the load sensor 38. The pressure forces applied to the grinding shaft 22 can be displayed on the display section 68.

Next, procedure of grinding the works with use of the grinding apparatus described above will be explained below. Under condition that the works W are set in the holding holes 18 of the carrier 17, at first, the grinding head 21 is moved up and down by the elevation motor 63, so the upper grinding wheel 24 is positioned to be opposed to the lower grinding wheel 13 through the works W. By operating the switch valve 57*a* in this state, a compressed air at a predetermined pressure is supplied to the primary pneumatic cylinder 35. In this manner, the upper grinding wheel 24 is brought into contact with the surfaces of the works W.

The pressure force applied to the works W through the grinding shaft 22 is detected by the load sensor 38. If there is a deviation from the preset pressure force, a signal corresponding to the deviation is outputted to the pressure regulator 56, and an operation signal is supplied to the switch valve 58, so the pressure force is corrected by the lever member.

Thus, the works W are applied with a primary load depending on the primary pneumatic cylinder 35 applied with a first air pressure $P_1$, and a secondary load depending on the secondary pneumatic cylinder 45 applied with a secondary air pressure $P_2$, which loads are combined with each other, so the pressure force is controlled with high precision by controlling the secondary load depending on the secondary pneumatic cylinder 45 applied with a high pressure.

In case where the ratio of $L_1$:$L_2$ is set to 5:1 as shown in the figure, the load which is five times larger than the secondary load applied to the position of the action point depending on the pin 44 is controlled, as for the load applied to the portion of the load point at the pin 47 by the piston rod 46. Thus, since control of a large load is performed, the pressure force applied to the grinding shaft 22 can be controlled with high precision.

By rotating and driving the upper grinding wheel 24 and the lower grinding wheel 13 under condition that a predetermined pressure force is applied, both surfaces of each work W are simultaneously processed. After completion of the processing, conduction through the switch valve 57*a* is stopped and the conduction to the switch valve 57*b* is made, so the grinding shaft 22 is moved up by a predetermined stroke. The grinding head 21 is moved up by the head elevation motor 63, and the works W are picked out from the grinding apparatus.

In the present embodiment, explanations has been made of a case where grinding wheels as grinding tools are respectively set on the upper platen 23 and the lower platen 12, to perform the process of grinding the works. However, the grinding apparatus shown in the figures is applicable to the case where polishing process is performed. The grinding process and the polishing process are totally called grinding-polishing process. The polishing process includes lapping for adjusting dimension errors of works and for improving the surface finish, and includes polishing for forming a mirror surface with high precision. A buff or the like is used as a polishing tool in each case. In case of the lapping, alumina powder, silicon carbide powder, glass powder, diamond powder, or the like is used as abrasive grains for lapping. In case of the polishing, abrasive grains having much smaller grains than those for the lapping are used.

The present invention should not be limited to the embodiment described above, and may be variously modified within the scope of the invention not departing from the gist.

For example, although the embodiment has been explained with reference to the case of grinding both surfaces of each work, the present invention is applicable to a case where only one surface of each work is ground. In this case, works are not provided on the lower grinding wheel but are directly provided on a rotation table or a fixed table. Also, the present invention is applicable not only to the case where a plurality of works are processed simultaneously but also to the case where works are processed one after another. Although the pneumatic cylinders 35 and 45 are used in the case shown in the figures, any fluid can be used as long as the cylinders are of a type such as a hydraulic cylinder that uses fluid as its operation medium. The work is not limited to an aluminum substrate but a glass substrate can be ground and/or polished.

According to the present invention, a pressure force depending on a primary load is directly applied to a grinding shaft by a primary fluid pressure cylinder applied with a first fluid pressure, and a pressure force depending on a secondary load is indirectly applied to the grinding shaft through a lever member as for a secondary fluid pressure cylinder applied with a second pressure higher than the first fluid pressure. Therefore, the secondary load can be controlled with high precision, so the pressure force applied to the grinding shaft can be controlled with high precision. As a result, the ground surfaces of the works are applied with a pressure force with fewer errors, and the works can be ground with high precision.

What is claimed is:

1. A grinding method comprising steps of:

rotating and driving a grinding tool in contact with a work, by a grinding shaft;

supplying a first fluid pressure to a primary fluid pressure cylinder having a first piston rod connected with said grinding shaft, thereby to apply a primary load to said grinding shaft;

supplying a second fluid pressure higher than said first fluid pressure, to a secondary fluid pressure cylinder having a second piston rod connected between both end portions of a lever member connected to said first piston rod, said lever member having a swing center portion at one of said end portions, and said other one of said end portions being connected with said first piston rod;

controlling said second fluid pressure to adjust said secondary load; and grinding said work by said grinding tool under condition that said primary load and said secondary load adjusted are applied to said grinding shaft.

2. A grinding apparatus comprising:

a support base for supporting a work;

a grinding head provided with a grinding shaft for rotating and driving a grinding tool for grinding said work, said grinding head being provided to be opposed to said support base;

a primary fluid pressure cylinder operated by a first fluid pressure, said primary fluid pressure cylinder having a first piston rod connected to said grinding shaft;

a lever member having end portions, one of which portions is set on said grinding head such that said lever member can swing, and the other of which portions is connected with said first piston rod;

a secondary fluid pressure cylinder operated by a second fluid pressure higher than said first fluid pressure, said secondary fluid pressure cylinder having a second piston rod connected between both end portions of said lever member; and a fluid pressure regulation means for controlling said second fluid pressure applied to said secondary fluid pressure cylinder, wherein a primary load depending on said primary fluid pressure cylinder is applied to said grinding shaft and a secondary load depending on said secondary fluid pressure cylinder is applied to said grinding shaft through said lever member.

3. An apparatus according to claim 2, wherein a pressure receiving area of said secondary fluid pressure cylinder is set to be smaller than a pressure receiving area of said primary fluid pressure cylinder.

* * * * *